US007441970B2

(12) United States Patent
Squires et al.

(10) Patent No.: US 7,441,970 B2
(45) Date of Patent: Oct. 28, 2008

(54) RIBBON TENSIONING MECHANISMS

(75) Inventors: Milo B Squires, Chaska, MN (US); Dennis J. Warwick, Richfield, MN (US); Richard C. Nubson, Eden Prairie, MN (US)

(73) Assignee: DataCard Corporation, Minnetonka, MN (US)

( * ) Notice: Subject to any disclaimer, the term of this patent is extended or adjusted under 35 U.S.C. 154(b) by 0 days.

(21) Appl. No.: 11/271,599

(22) Filed: Nov. 10, 2005

(65) Prior Publication Data

US 2007/0104526 A1 May 10, 2007

(51) Int. Cl.
*B41J 35/08* (2006.01)

(52) U.S. Cl. ..... 400/234; 400/238

(58) Field of Classification Search ..... 400/238, 400/225; 235/381, 487; 347/214
See application file for complete search history.

(56) References Cited

U.S. PATENT DOCUMENTS 3,621,969 A * 11/1971 Gotschewski ..... 400/219.5
4,456,193 A * 6/1984 Westover ..... 242/421.9
4,747,715 A * 5/1988 Lahr ..... 400/248.3
4,770,553 A * 9/1988 Deschamps et al. ..... 400/208
5,051,011 A * 9/1991 Satoh et al. ..... 400/219
5,080,512 A * 1/1992 Schofield et al. ..... 400/225
5,266,972 A * 11/1993 Gotho et al. ..... 347/176
5,281,038 A * 1/1994 Schofield et al. ..... 400/235
5,415,482 A * 5/1995 Poole et al. ..... 400/248
5,419,648 A * 5/1995 Nagao et al. ..... 400/208
5,433,539 A * 7/1995 German ..... 400/225
5,466,076 A * 11/1995 Kobayashi et al. ..... 400/248
5,588,763 A * 12/1996 Nubson et al. ..... 400/700
5,607,244 A * 3/1997 Satoh et al. ..... 400/247
5,709,485 A * 1/1998 Kohno ..... 400/208
5,709,488 A * 1/1998 Imai et al. ..... 400/234
5,713,678 A * 2/1998 Smith et al. ..... 400/613
5,779,373 A * 7/1998 Tukahara et al. ..... 400/208
5,842,796 A * 12/1998 Horie ..... 400/208
5,873,662 A * 2/1999 Clevinger ..... 400/234
5,886,726 A * 3/1999 Pawelka et al. ..... 347/197
5,921,689 A * 7/1999 Buckby et al. ..... 400/225
5,961,230 A * 10/1999 Bellotto ..... 400/225
6,065,883 A * 5/2000 Herring et al. ..... 400/225
6,078,343 A * 6/2000 Jordan ..... 347/188
6,082,914 A * 7/2000 Barrus et al. ..... 400/234
6,089,768 A * 7/2000 Barrus et al. ..... 400/238
6,095,701 A * 8/2000 Sattler ..... 400/120.17
6,149,329 A * 11/2000 Tuli ..... 400/634

(Continued)

FOREIGN PATENT DOCUMENTS

JP 62-264980 11/1987

(Continued)

*Primary Examiner*—Manish S Shah
(74) *Attorney, Agent, or Firm*—Hamre, Schumann, Mueller & Larson, P.C.

(57) ABSTRACT

Identity document processing equipment with a mechanism designed to maintain tension in a ribbon used in a processing operation in the processing equipment. The tension maintaining mechanism is separate from the supply roll and the take-up roll for the ribbon, eliminating the need for clutches or brakes attached to the supply or take-up rolls to achieve tensioning. Since the tension maintaining mechanism is separate from the supply roll and the take-up roll, the inertia of the supply roll or the take-up roll does not affect the tension on the ribbon during use of the processing equipment.

17 Claims, 8 Drawing Sheets

U.S. PATENT DOCUMENTS

| | | | | |
|---|---|---|---|---|
| 6,155,729 | A * | 12/2000 | Ishida et al. | 400/234 |
| 6,263,796 | B1 * | 7/2001 | Jordan | 101/486 |
| 6,308,886 | B1 * | 10/2001 | Benson et al. | 235/375 |
| 6,446,832 | B1 * | 9/2002 | Holec et al. | 221/88 |
| 6,520,696 | B2 * | 2/2003 | Huss et al. | 400/208 |
| 6,783,067 | B2 * | 8/2004 | Kreuter et al. | 235/381 |
| 6,902,107 | B2 * | 6/2005 | Shay et al. | 235/381 |
| 7,018,117 | B2 * | 3/2006 | Meier et al. | 400/208 |
| 2003/0128269 | A1 * | 7/2003 | Squires et al. | 347/214 |

FOREIGN PATENT DOCUMENTS

| | | |
|---|---|---|
| JP | 63-237979 | 10/1988 |
| JP | 1-229678 | 9/1989 |
| JP | 2004-284206 | 10/2004 |

* cited by examiner

*Fig. 1 - Prior Art*
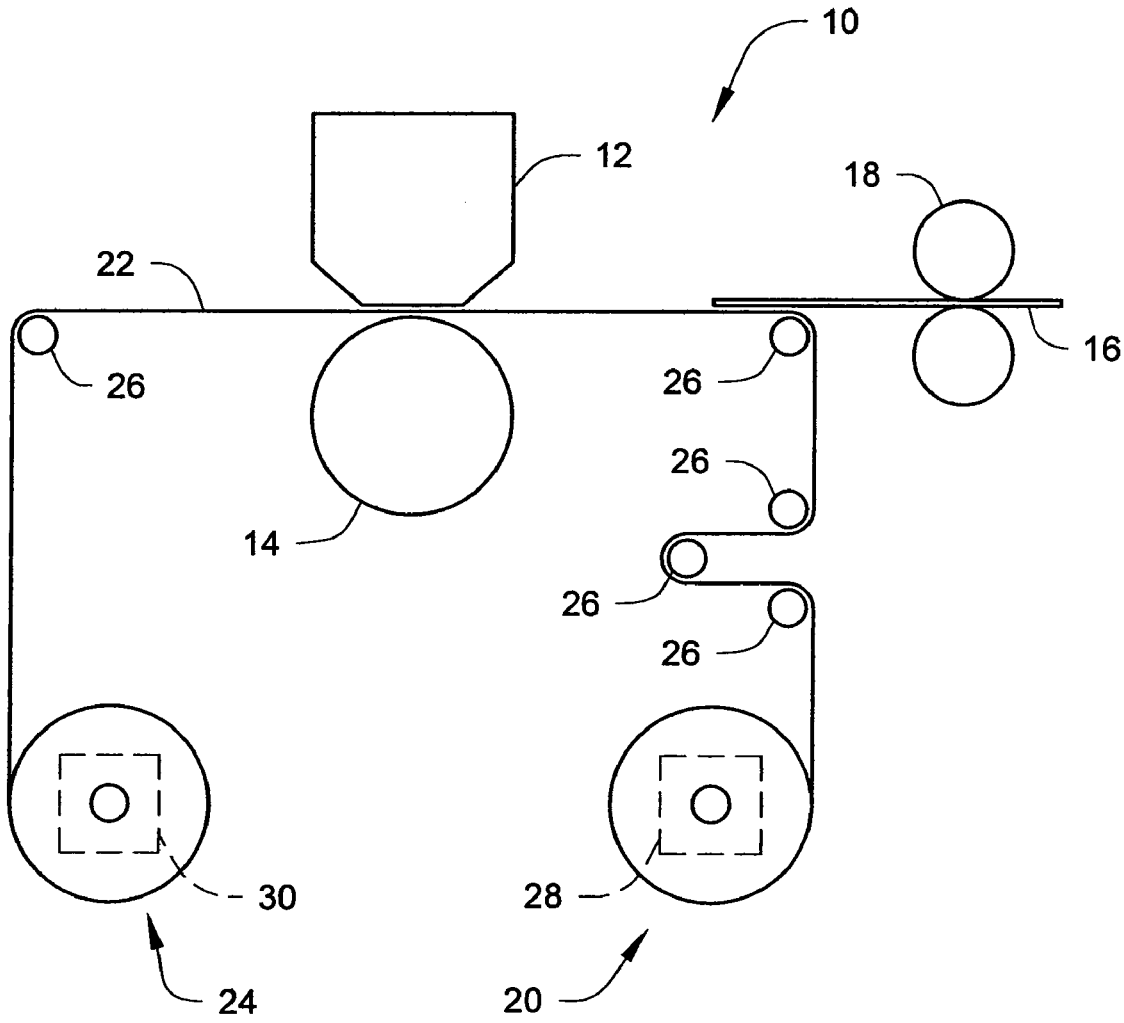

RIBBON TENSIONING MECHANISMS

FIELD OF THE INVENTION

The invention relates to mechanisms for tensioning a ribbon in identity document processing equipment. More particularly, the invention relates to mechanisms for maintaining tension in a ribbon during use of the ribbon in the identity document processing equipment and determining the amount of ribbon remaining using the tension maintaining mechanism.

BACKGROUND OF THE INVENTION

Identity documents are often processed in processing equipment configured to perform a variety of processing operations on the identity documents. For example, the processing can include the addition of information to the document that is unique to the intended holder of the identity document. The types of identity documents which are often processed include plastic and composite cards, such as financial (e.g. credit and debit) cards, drivers' licenses, national identification cards, and other cards, as well as passports.

For large volume, batch processing of identity documents, systems are known that employ multiple processing modules to process multiple identity documents at the same time and reduce the overall per document processing time. Examples of such systems include the systems disclosed in U.S. Pat. Nos. 6,902,107 and 6,783,067, and the DataCard MaxSys, 9000 and DPL4000 series systems available from DataCard Corporation of Minneapolis, Minn.

For smaller volume processing of identity documents, for example one at a time processing, desktop processing machines are known. Examples of desktop processing machines include the SP 75 and SP 55 machines, and the DPL40 machine, each of which is available from DataCard Corporation of Minneapolis, Minn.

In identity document processing equipment, a number of ribbons are used to process the documents. Ribbons that are used include multi-color and monochromatic print ribbons, and webs that are used to apply various topcoat and protective layers to the documents.

In many ribbons, it is important that uniform tension be maintained on the ribbon to optimize the resulting processing operation that uses the ribbon. For example, when thermal printing on a card, it is desirable to maintain uniform tension on the print ribbon, which translates into uniform ribbon and card motion, which translates into improved print quality.

With reference to FIG. 1, a known printer IO that is used in card processing equipment is schematically illustrated. The printer 10 includes a card processing mechanism 12 in the form of a thermal print head that performs thermal printing on plastic cards 16. A platen 14 in the form of a backing roller is positioned opposite the print head 12 to support the cards during printing. Cards are driven one by one into the nip between the print head 12 and the platen 14 by a suitable drive mechanism 18, for example a pair of drive rollers. A supply roll 20 supplies print ribbon 22 for use during the print process, and a take-up roll 24 takes up used print ribbon. The print ribbon 22 follows a ribbon path between the supply roll 20 and the take-up roll 24 and past the print head 12, guided by a plurality of ribbon guides 26.

It is common to have clutches or brakes attached to the supply and take-up rolls for tensioning the ribbon 22 and to account for differences in speed or distance traveled by the ribbon relative to the card or the supply and take-up rolls. Clutches/brakes 28, 30 are illustrated in dashed lines on the supply and take-up rolls in FIG. 1. Since the clutch or brake parts are often attached to the spindles of the supply and take-up rolls, the amount of tension that is delivered to the ribbon will change significantly depending on the amount of ribbon on the rolls. A friction roller is commonly used on the take-up side to control ribbon motion. But a friction roller prevents accurate motion of the ribbon when the ribbon is reversed in direction, as the friction roller tends to loosen the roll and the friction roller can slip.

Further, since the ribbons are consumable items in the processing equipment, it is desirable to be able to track how much ribbon has been used and monitor how much ribbon remains to be used.

SUMMARY OF THE INVENTION

The invention relates to identity document processing equipment with a mechanism designed to maintain tension in a ribbon used in a processing operation in the processing equipment. The tension maintaining mechanism is separate from the supply roll and the take-up roll for the ribbon, eliminating the need for clutches or brakes attached to the supply or take-up rolls to achieve tensioning.

Since the tension maintaining mechanism is separate from the supply roll and the take-up roll, the inertia of the supply roll or the take-up roll does not affect the tension on the ribbon during use of the processing equipment. This permits the use of larger supply rolls without degrading the quality of the resulting processing operation using the ribbon. Where the identity document processing equipment comprises a thermal print mechanism, uniform ribbon tension and isolating the supply roll'S inertia from the ribbon motion helps to achieve uniform ribbon and card motion during printing which translates into improved print quality.

The tension maintaining mechanism can also be used to help determine the diameter of the supply roll and/or the take-up roll which provides an indication of the amount of ribbon remaining on the supply roll. The information relating to the amount of ribbon remaining can then be provided to the system controller and/or saved in a suitable memory device, for example system memory or memory on a radio frequency identification tag.

In addition, the tension maintaining mechanism can be used to help determine when the end of the ribbon on the supply roll has been reached. Since the amount of ribbon remaining on the supply roll can be monitored, the system knows when the end of the ribbon is approaching, and the configuration of the tension maintaining mechanism provides an indication once the end of the ribbon has been reached.

In one aspect of the invention, identity document processing equipment is provided that comprises a document processing mechanism configured to process an identity document by performing a processing operation on the identity document, a supply roll containing consumable ribbon to be used by the document processing mechanism, a take-up roll for taking up used ribbon, a ribbon path along which the ribbon travels between the supply roll and the take-up roll and to the document processing mechanism, and a plurality of ribbon guides guiding the ribbon along the ribbon path. One of the ribbon guides is mounted so as to be movable to change the length of the ribbon path between the supply roll and the take-up roll. In addition, a resilient member is connected to the movable ribbon guide to resiliently bias the movable ribbon guide so as to apply a generally constant tension to the ribbon. The movable ribbon guide is positioned in the ribbon path between the document processing mechanism and the supply roll.

In another aspect of the invention, a method of maintaining tension in a ribbon in identity document processing equipment is provided. The processing equipment has a document processing mechanism configured to process an identity document by performing a processing operation on the identity document. The method includes providing a movable ribbon guide in a ribbon path between a supply roll supplying the ribbon and the document processing mechanism, where the movable ribbon guide is engaged with the ribbon. In addition, a resilient bias is applied to the movable ribbon guide to apply a generally constant tension to the ribbon.

DRAWINGS

FIG. 1 schematically depicts a known print mechanism of document processing equipment.

Figure 4:
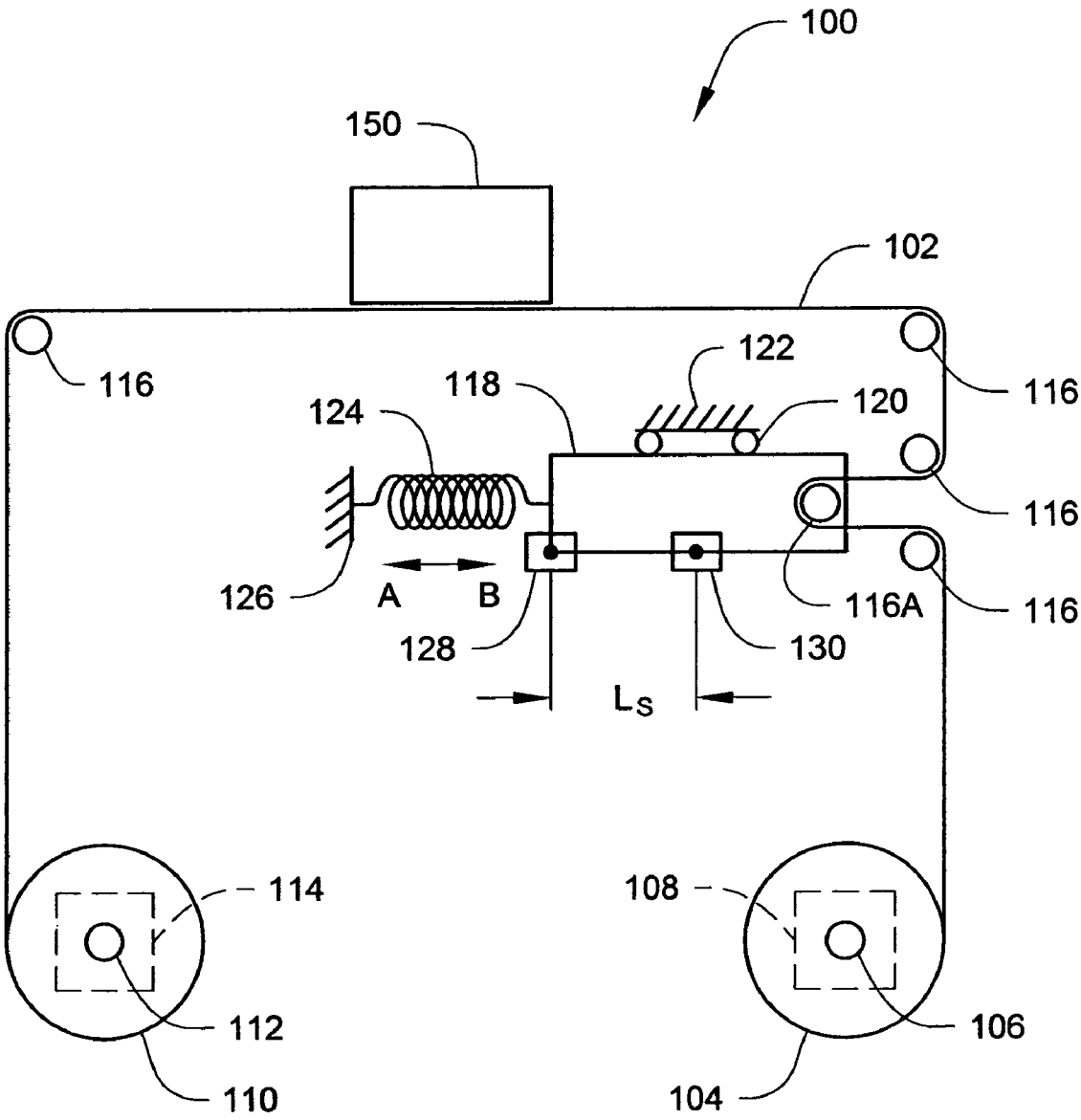
FIG. 4 is a top view of an overlay module for use in document processing equipment including an alternate embodiment of a ribbon tensioning mechanism.
Figure 7A:
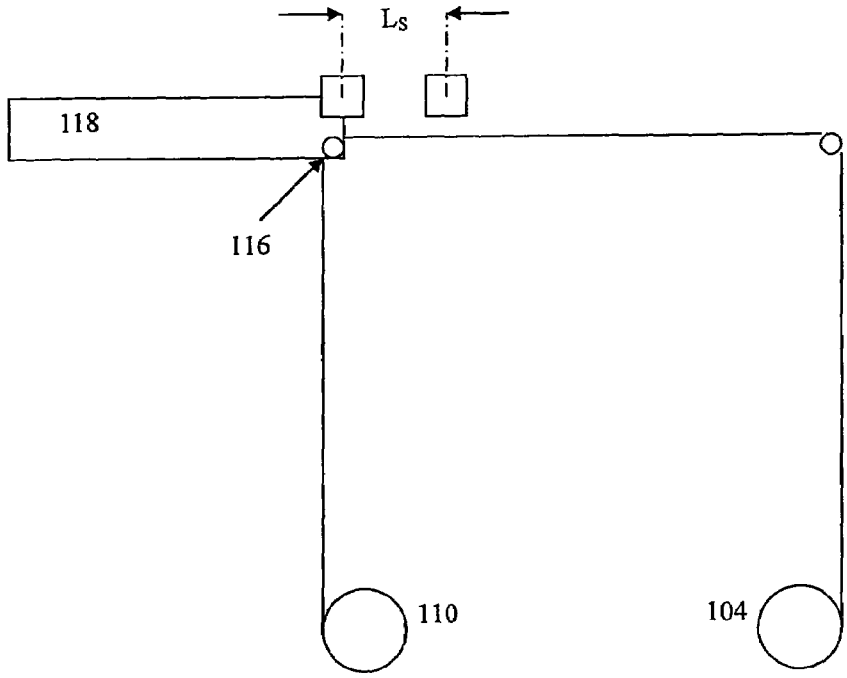
Figure 7B:
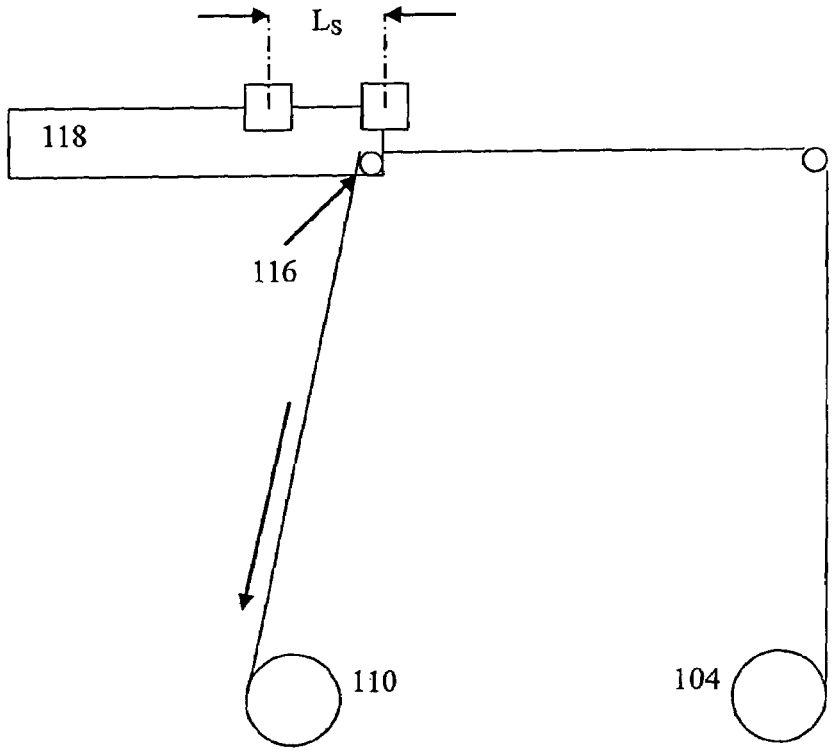
Figure 7C:
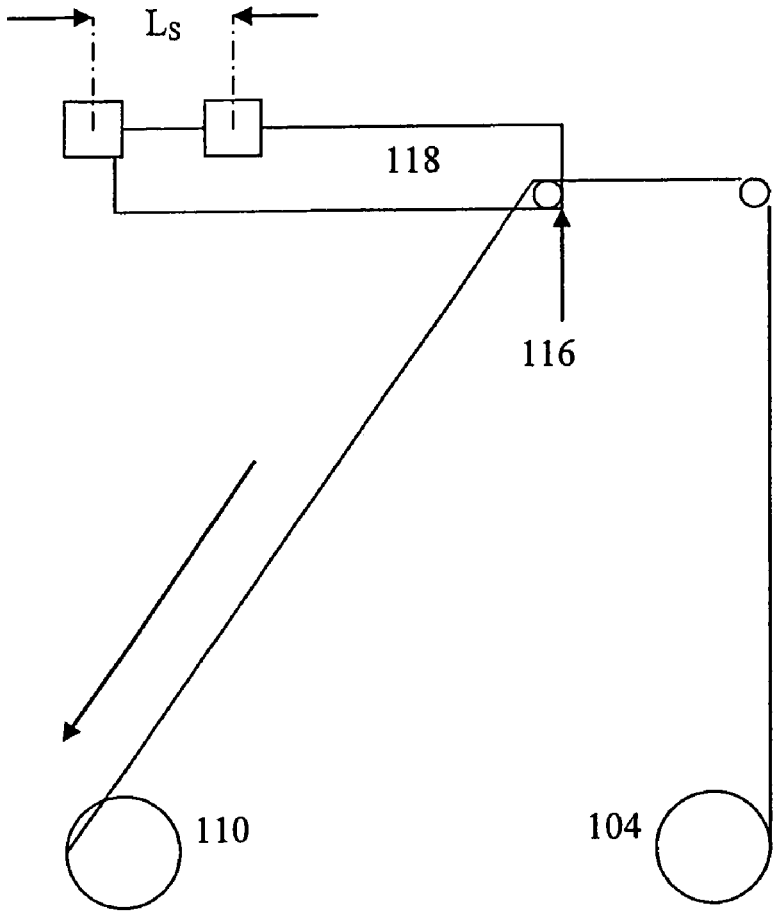

FIGS. 7A-C illustrate a variation of the ribbon tensioning mechanism shown in FIG. 4.

DETAILED DESCRIPTION

The invention relates to mechanisms for maintaining tension in a ribbon in identity document processing equipment during use of the ribbon in the identity document processing equipment and determining the amount of ribbon remaining using the tension maintaining mechanism.

The identity documents can be plastic and composite cards, such as financial (e.g. credit and debit) cards, drivers' licenses, national identification cards, and other cards, as well as passports. The document processing equipment can be equipment used to process these types of documents. The processing that is performed on the identity documents can include printing and the application of one or more layers to surfaces of the documents, for example applying topcoat and protective layers to the documents. The term ribbon as used herein and in the claims is intended to include multi-color and monochromatic print ribbons, and webs that are used to apply various topcoat and protective layers to the documents.

One embodiment of the invention will be described with respect to a tension maintaining mechanism for maintaining tension on a multi-color print ribbon in a thermal printer that performs printing operations on an identity document in the form of a card. A second embodiment of the invention will be described with respect to a tension maintaining mechanism for maintaining tension on a web in an overlay mechanism that applies a protective layer to an identity document in the form of a passport. It is to be realized that the concepts described herein could be used to maintain tension in other types of webs in other types of identity document processing equipment.

Figure 2A:
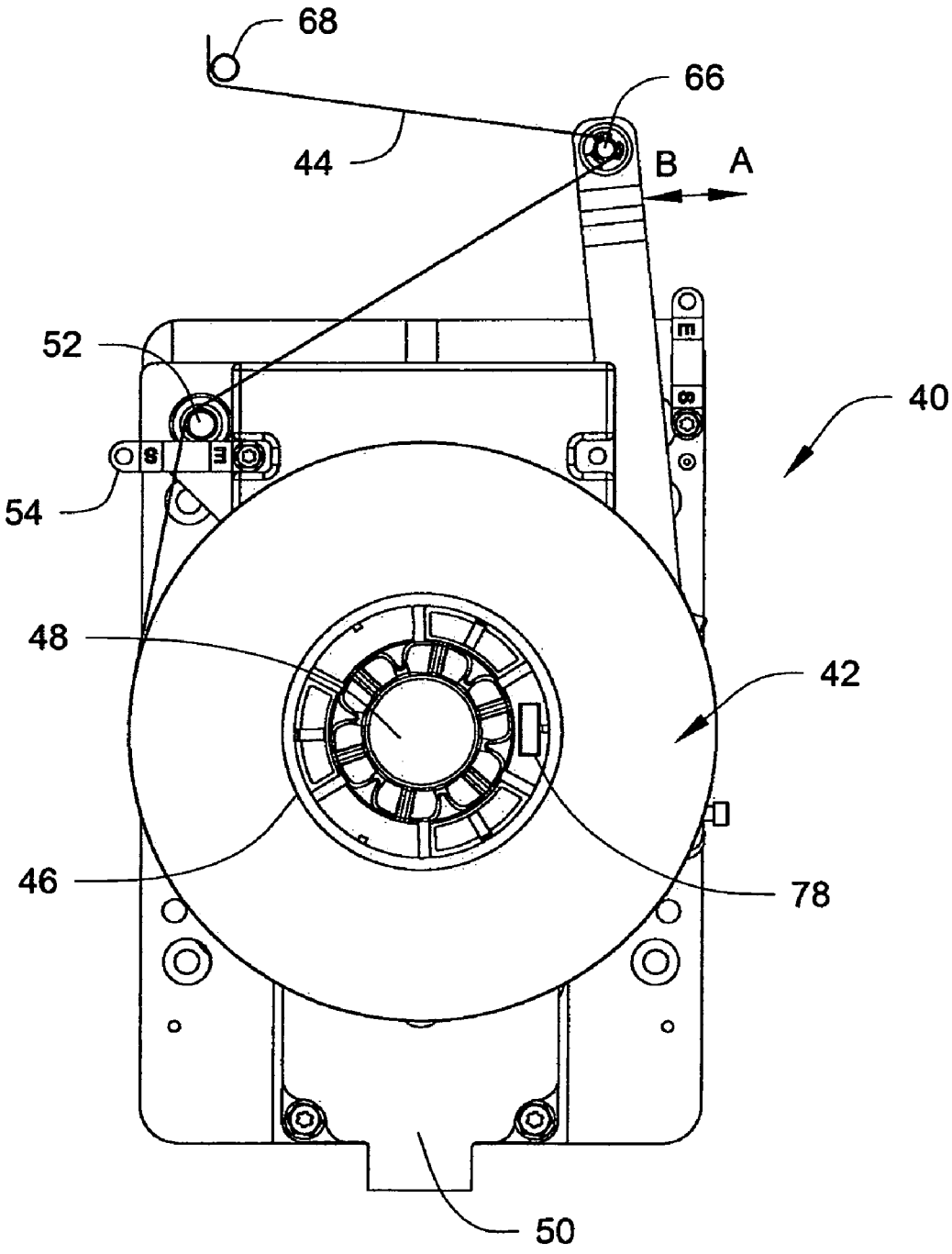
FIG. 2A is a top view of the supply side of a print station including a ribbon tensioning mechanism according to the invention, with the pivoting arm at a home position.
Figure 2B:
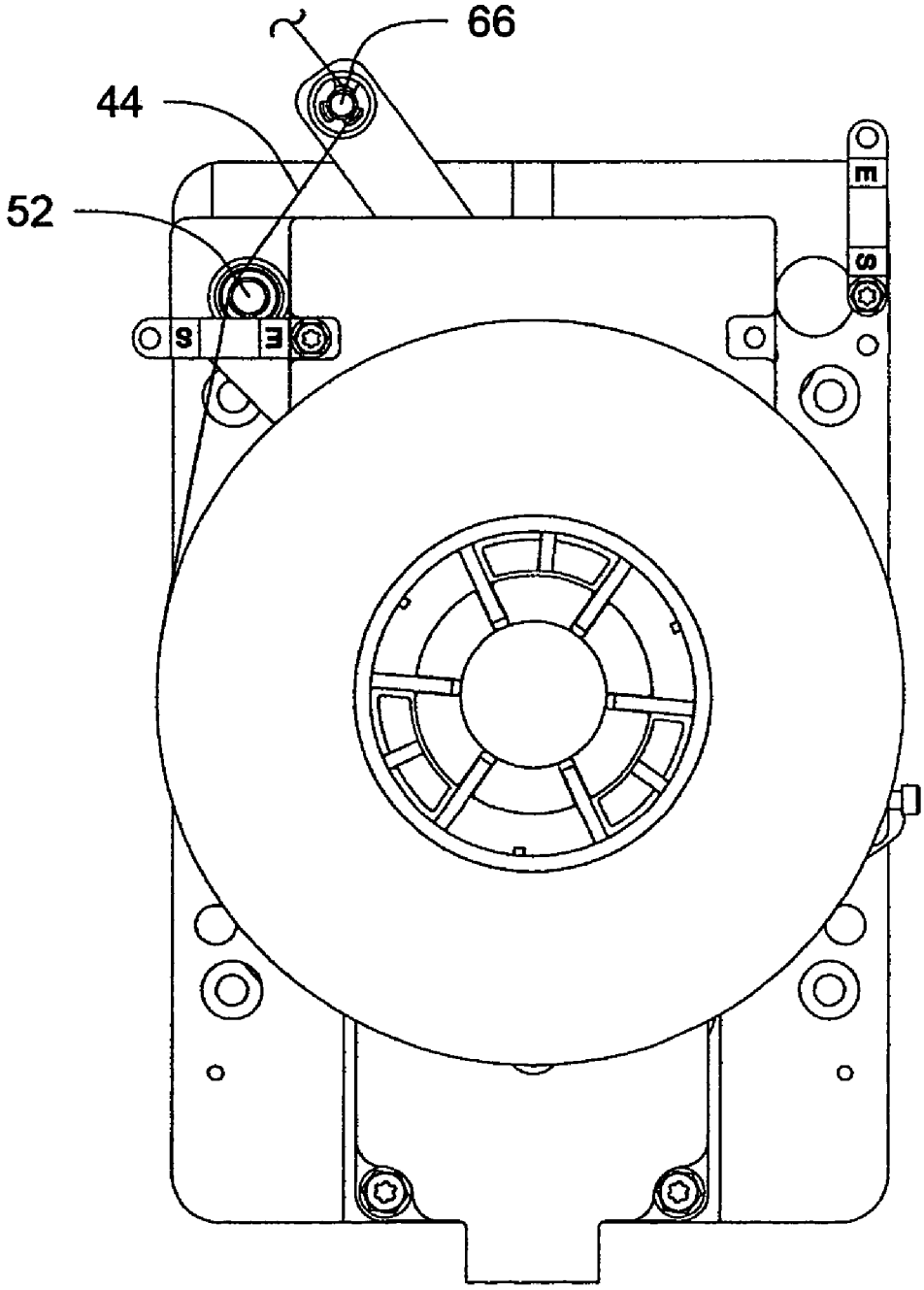
FIG. 2B is a top view similar to FIG. 2A, but with the pivoting arm pivoted away from the home position at the end of a printing pass.
Figure 3:
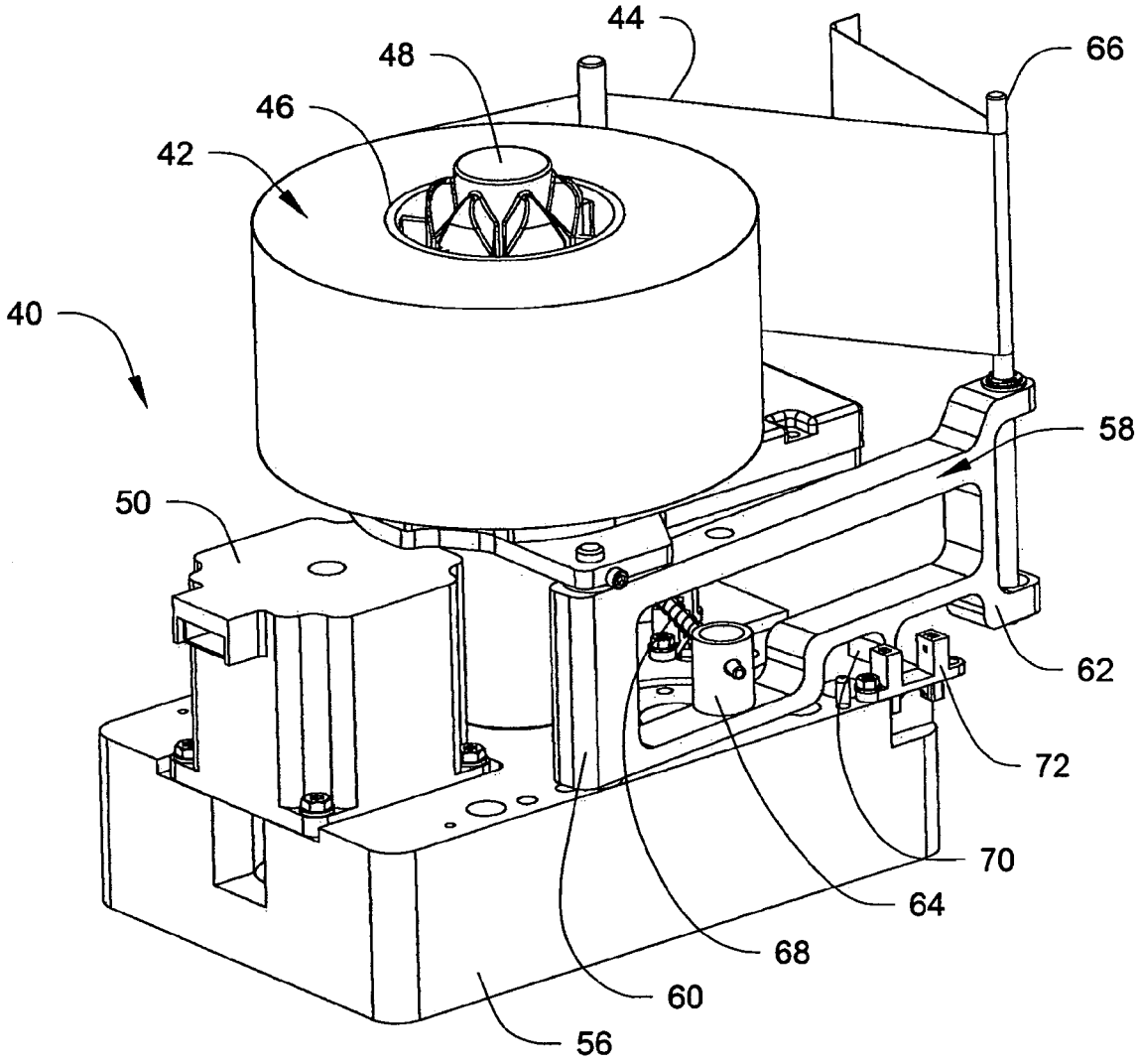
FIG. 3 is a perspective view of the supply side of the print station of FIG. 2.

With reference to FIGS. 2 and 3, a supply side 40 of a thermal print station in a card printer according to the invention is illustrated. The supply side 40 includes a supply roll 42 containing an amount of print ribbon 44 waiting to be used. The ribbon 44 is disposed on a supply roll core 46, and the core 46 is disposed on a spindle 48 for rotating the roll 42. The spindle 48 is rotatably mounted on a base 56 that is mounted in the printer. The spindle 48 is driven by a motor 50, for example a stepper motor, that is in driving engagement with the spindle 48 for feeding ribbon 44 from the roll 42.

A ribbon guide 52 is mounted near the roll 42 acting as an initial guide for the ribbon as it leaves the roll 42. A sensing mechanism 54, for example a photocell, adjacent the roll 42 senses the ribbon 44 during normal operation. If the sensing mechanism 54 does not detect the ribbon 44, that can indicate to the printer that the end of the ribbon has been reached or that a break in the ribbon has occurred.

As best seen in FIG. 3, an arm 58 is pivotally mounted on the base 56. The arm 58 includes a first end 60 that is pivotally attached to the base 56 to enable the arm 58 to pivot during printing, and a second end 62 that pivots about the pivot axis of the first end 60. A resilient member, for example a spring 68 shown in FIG. 3, applies a force to the arm 58 through a link 64 to bias the arm in a clockwise direction A as shown by the arrow in FIG. 2.

A ribbon guide 66, for example an idler roller, is attached to the second end 62 and extends upwardly therefrom for guiding the ribbon 44. Further, the bottom of the arm 58 is provided with a tab 70 that projects downwardly therefrom. A sensor 72, for example a photocell, is provided on the base 56 for sensing the tab 70 and thereby detecting movements of the arm 58. The sensor 72 is positioned at a home position to detect a home position of the arm 58. A known length of ribbon is wrapped on to the take up roll as the arm 58 is pulled away from the home position. The number of supply motor steps it takes to return the arm to it'S home position can then be used to track the amount of ribbon used.

Further ribbon guides 68, one of which is shown in FIG. 2, a thermal print head, and a take-up roll, generally similar to the arrangement shown in FIG. 1, will function with the supply side 40.

During a printing operation, a card and ribbon 44 move together past the printhead during a printing pass. Rather than moving the roll 42 during printing, the arm 58 pivots in the direction of the arrow B in FIG. 2 during printing due to the take-up roll pulling the ribbon 44 past the printhead. The pivoting movement of the arm 58 in direction B decreases the length of the ribbon path between the supply roll 42 and the take-up roll, thereby feeding the print ribbon to the printhead during the printing pass. At the same time, the resilient bias on the arm 58 in the direction A maintains a constant tension on the ribbon 44.

Because the supply roll 42 does not move during printing, the supply roll'S motion, which is affected by its inertia, does not affect the ribbon tension during printing. Due to the uniform tension on the print ribbon, uniform motion of the ribbon and card past the printhead is achieved, which translates into higher quality printing. This permits the use of larger supply rolls, thereby reducing the frequency of supply roll changes, without degrading print quality.

Further, this design permits determination of the amount of ribbon remaining on the supply roll 42. After each print pass, the motor 50 rotates the supply roll 42 to feed additional ribbon. At the same time, the bias spring 68 acting on the link 64 causes the arm 58 to pivot to the home position as detected by the sensor 72. The motor 50 can rotate the spindle 48 and supply roll 42 feeding out ribbon 44 allowing the arm 58 to rotate back to the home position. In the case where the motor 50 is a stepper motor, the number of steps $N_S$ required to rotate arm 58 back to the home position and the length of the ribbon $L_P$ removed from the supply roll during one process cycle can be used to determine the diameter of the supply roll 42 using the following equations.

$$L_P = X\,C_S = (N_S/N_T)(\pi D_S) \text{ or } D_S = L_P N_T / \pi N_S, \text{ where}$$

$L_P$ is the length of ribbon removed from the supply roll during processing;

X is the fraction of one revolution of the supply roll in terms of steps;

$C_S$ is the circumference of the supply roll;

$D_S$ is the diameter of the supply roll;

$N_S$ is the number of motor steps needed to return the arm to it home position;

$N_T$ is the motor steps required to rotate the supply spindle one revolution.

Once the diameter is calculated, the ribbon remaining on the roll can be determined using the equation $\%_R = (D_S^2 - D_E^2)/(D_F^2 - D_E^2)$, where $\%_R$ is the percent of ribbon that is remaining on the supply roll;

$D_S$ is the diameter of the supply roll;

$D_E$ is the diameter of an empty supply roll;

$D_F$ is the diameter of a full supply roll.

The information regarding the ribbon remaining on the roll can then be provided to the printer controller and/or the information can be saved in a suitable storage device, such as memory in a radio frequency identification tag 78 (shown schematically in FIG. 2) secured to the roll 42. An example of positioning a radio frequency identification tag on a roll and writing data to a radio frequency identification tag is found in U.S. Patent Application Publication 2003/0128269 which is incorporated herein by reference in its entirety.

An alternate embodiment is illustrated in FIG. 4, which schematically illustrates an overlay mechanism 100 for use in passport processing equipment. The overlay mechanism 100 is designed to apply a protective layer to a sheet in a passport. The protective layer is supplied on a ribbon or web 102. In this overlay mechanism, the passport and ribbon are stationary during application of the protective layer, in contrast to a card printer described with respect to FIGS. 2 and 3 where the ribbon and card move during printing. The processing mechanism 150 used to apply the protective layer to the passport sheet is shown schematically in FIG. 4. The construction and operation of overlay mechanisms for applying protective layers to sheets of passports are well known to those of skill in the art.

The overlay mechanism 100 includes a supply roll 104 containing an amount of ribbon 102 waiting to be used. The ribbon 102 is disposed on a supply roll core (not shown), and the core is disposed on a spindle 106 for rotating the roll 104. The spindle 106 is driven by a motor 108 (shown in dashed lines), for example a stepper motor, that is in driving engagement with the spindle 106 for feeding ribbon 102 from the roll 104.

A take-up roll 110 takes up used ribbon 102. The take-up roll 110 is disposed on a spindle 112 that is driven by a motor 114 (shown in dashed lines), for example a stepper motor.

A plurality of ribbon guides 116 serve to guide the ribbon 102 along the ribbon path. One of the ribbon guides, 116A, is mounted on a slide 118 that is movable in the directions A and B as indicated by the arrows in FIG. 4. The slide 118 includes rollers 120 that are engaged with a fixed structure 122 in the overlay mechanism 100 to slidingly support the slide 118. A resilient member 124, for example a coil spring, is connected at one end to the slide 118 and at its opposite end to a fixed structure 126 in the overlay mechanism 100. The resilient member 124 biases the slide in the direction A in order to maintain a constant tension on the ribbon 102. A first sensor 128 and a second sensor 130 are provided to sense movements of the slide 118.

Because the ribbon 102 does not move during application of the protective layer to the passport, the slide 118 is essentially stationary during application and applies a constant tension to the ribbon. This eliminates the need for clutches and/or brakes on the supply roll 104 and the take-up roll 110. Since the rolls are driven directly by the motors 108, 114 rather than through clutches or brakes, either roll 104, 110 can be moved forward or reversed for positioning the ribbon 102.

The amount of tension in the ribbon 102 is controlled by using either or both of the motors 108, 114 so that the slide 118 is moved to a predetermined position after moving the ribbon to the required position relative to the processing mechanism 150. If more tension is desired, one or both of the motors 108, 114 are activated to move the slide 118 to the right in FIG. 4 to achieve a greater tension. The resilient member 124 can be configured so that less tension is applied to the ribbon 102 when the slide 118 is aligned with the sensor 128, and more tension is applied to the ribbon 102 when the slide 118 is aligned with the sensor 130.

Figure 5A:
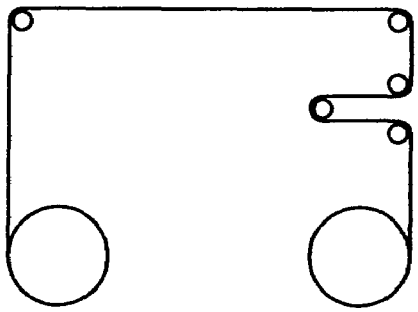
FIGS. 5A-5C illustrate the use of the ribbon tensioning mechanism of FIG. 4 to determine roll diameters.
Figure 5B:
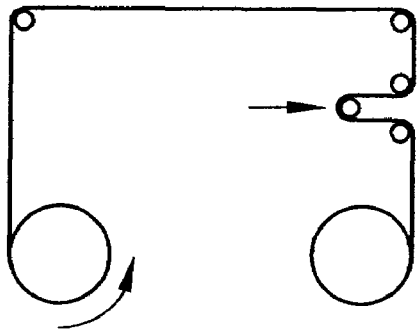

With reference to FIG. 5 and to FIG. 4, the embodiment illustrated in FIG. 4 can be used to determine the sizes, for example the diameters, of the supply roll 104 and take-up roll 110. Starting with the slide 118 aligned with the sensor 128 as in FIG. 5A, the take-up roll 110 is rotated counterclockwise to advance the ribbon 102. As this occurs the supply roll 104 is fixed. As a result, the length of the ribbon path decreases, which causes the slide 118 to move to the right as shown in FIG. 5B. The ribbon 102 is advanced until the slide 118 aligns with the sensor 130. In the case where the motor 114 is a stepper motor, the number of steps needed to move the slide 118 from the sensor 128 to the sensor 130 is counted. The diameter of the take-up roll 110 is then determined by the following equation:

$$D_T = L_S N_R \div \pi N_S \text{ where}$$

$D_T$ is the diameter of the take-up roll;

$L_S$ is the distance the ribbon moves as the slide travels between the sensors 128, 130;

$N_R$ is the number of steps needed to rotate the roll 360 degrees; and $N_S$ is the number of steps counted.

Figure 5C:
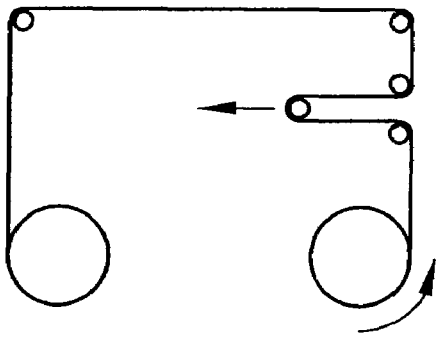

To determine the diameter of the supply roll 104, the supply roll 104 is then rotated counterclockwise, while the take-up roll 110 remains fixed, as shown in FIG. 5C. This decreases the tension of the ribbon 102 and allows the slide 118 to move back to the left. The supply roll 104 is rotated until the slide 118 realigns with the sensor 128. In the case where the motor 108 is a stepper motor, the number of steps is counted. The diameter is then calculated by the following equation:

$$D_S = L_S N_R \div \pi N_S \text{ where}$$

$D_S$ is the diameter of the supply roll;

$L_S$ is the distance the ribbon moves as the slide travels between the sensors 128, 130;

$N_R$ is the number of steps needed to rotate the roll 360 degrees; and $N_S$ is the number of steps counted.

Figure 6A:
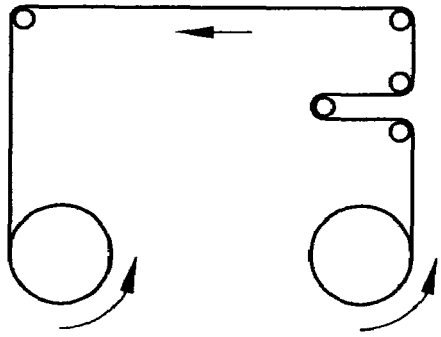
FIGS. 6A-6C illustrate the use of the ribbon tensioning mechanism of FIG. 4 to determine when the end of the roll is reached.
Figure 6B:
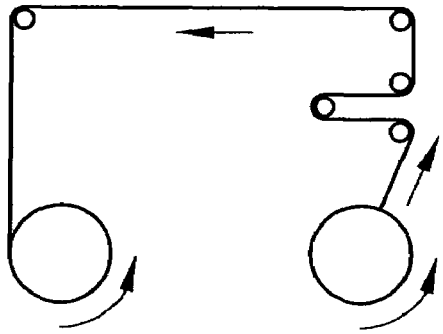
Figure 6C:
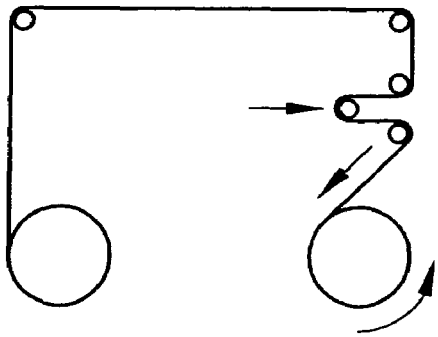

The embodiment in FIG. 4 can also be used to determine that the end of the ribbon on the supply roll has been reached. With reference to FIG. 6A, both the take-up roll 110 and the supply roll 104 are rotated counterclockwise to advance the ribbon 102 with the slide remaining generally stationary. As shown in FIG. 6B, once the end of the ribbon is reached, continued rotation of the supply roll will not feed out additional ribbon past the point shown in FIG. 6B. Because the take-up roll 110 continues to rotate, the slide 118 will be forced to move from the sensor 128. Once the slide 118 moves away from the sensor 128, the rotation of the take-up roll 110 is stopped. Continued rotation of the supply roll 104 pulls the ribbon backward and moves the slide 118 into alignment with the sensor 130, as shown in FIG. 6C. This sequence of movements signals that the end of the roll has been reached.

FIGS. 7A-C illustrate a variation of the mechanism shown in FIG. 4, with elements corresponding to those in the mechanism in FIG. 4 being denoted with the same reference numeral. In the embodiment shown in FIGS. 7A-C, the slide 118 is moved to the upper left of the mechanism, with the upper left ribbon guide 116 mounted on the slide 118 and the ribbon 102 extending in a generally straight path from the supply roll 104 to the first ribbon guide 116. FIG. 7A illustrates the slide 118 at a home position. FIG. 7B illustrates the slide at a measure position with the slide 118 having traveled from one sensor to the other sensor. FIG. 7C illustrates the slide 118 at an end of travel position. In this embodiment, due to the position and travel of the slide 118, the processing mechanism 150 (not illustrated in FIGS. 7A-C) can be positioned between the supply roll 104 and the first ribbon guide 116. The constructions and operation of the mechanism in FIGS. 7A-C is otherwise similar to the construction and operation of the embodiment illustrated in FIG. 4.

Further embodiments and alterations consistent with the inventive concepts described herein can be utilized. For example, the resilient mechanisms can be resilient mechanisms other than springs or in combination with springs, for example one or more elastomeric members. The motors used to drive the supply and take-up rolls can be any type of motors that allow a user to determine the amount of rotation of the motors. The sensors can be any type of sensors capable of monitoring movements of the arm or slide. The ribbon guides can be rollers or fixed pins, or a combination of both.

The invention claimed is:

1. Identity document processing equipment, comprising:

a document processing mechanism configured to process an identity document by performing a processing operation on the identity document;

a supply roll containing consumable ribbon to be used by the document processing mechanism;

a motor in driving engagement with the supply roll to rotate the supply roll;

a take-up roll for taking up used ribbon;

a ribbon path along which the ribbon travels between the supply roll and the take-up roll and to the document processing mechanism;

a plurality of ribbon guides guiding the ribbon along the ribbon path, wherein one of the ribbon guides is mounted so as to be movable to change the ribbon path between the supply roll and the take-up roll, and a resilient member is connected to the ribbon to apply a generally constant tension to the ribbon, and the movable ribbon guide is positioned in the ribbon path between the supply roll and the take-up roll, the movable ribbon guide comprises a guide mounted on an arm that is pivotally mounted adjacent to, and generally away from a central axis of, the supply roll so that the arm can pivot relative to the supply roll, and the resilient member is connected to the arm, and wherein at least one of the plurality of ribbon guides is positioned in the ribbon path between the supply roll and the ribbon guide that is mounted to be movable.

2. The identity document processing equipment of claim 1, wherein the document processing mechanism comprises a printer and the ribbon comprises a print ribbon.

3. The identity document processing equipment of claim 1, wherein the document processing mechanism comprises an overlay mechanism, and The ribbon comprises a web material having overlay material thereon.

4. The identity document processing equipment of claim 1, further comprising a sensor for sensing movements of the arm.

5. The identity document processing equipment of claim 1, wherein The resilient member biases the arm in a direction away from the central axis of the supply roll to increase the length of the ribbon path.

6. Identity document processing equipment, comprising:

a document processing mechanism configured to process an identity document by performing a processing operation on the identity document;

a supply roll containing consumable ribbon to be used by the document processing mechanism;

a motor in driving engagement with the supply roll to rotate the supply roll;

a take-up roll for taking up used ribbon;

a ribbon path along which the ribbon travels between the supply roll and the take-up roll and to the document processing mechanism;

a plurality of ribbon guides guiding the ribbon along the ribbon path, wherein one of the ribbon guides is mounted so as to be movable to change the ribbon path between the supply roll and the take-up roll, and a resilient member is connected to the ribbon to apply a generally constant tension to the ribbon, and the movable ribbon guide is positioned in the ribbon path between the supply roll and the take-up roll, wherein at least one of the plurality of ribbon guides is positioned in the ribbon path between the supply roll and the ribbon guide that is mounted to be movable, and wherein the movable ribbon guide comprises a guide mounted on a slide that is mounted for linear movement in a direction parallel to the ribbon path past the document processing mechanism and the resilient member is connected to the slide.

7. The identity document processing equipment of claim 6, further comprising a sensor for sensing movements of the slide.

8. The identity document processing equipment of claim 6, wherein the resilient member biases the slide in a direction to increase the length of the ribbon path.

9. The identity document processing equipment of claim 6, wherein the consumable ribbon is protective overlay material, the slide is positioned between the supply roll and the document processing mechanism, and the slide is stationary during the processing operation on the identity document.

10. A method of maintaining tension in a ribbon in identity document processing equipment having a document processing mechanism configured to process an identity document by performing a processing operation on the identity document, the method comprising:

providing a movable ribbon guide in a ribbon path between a supply roll supplying the ribbon and a take-up roll, the movable ribbon guide being engaged with the ribbon, wherein the ribbon is stationary during the processing operation, and wherein the movable ribbon guide is stationary during the processing operation;

providing a fixed ribbon guide in the ribbon path between the movable guide ribbon and the supply roll, the fixed ribbon guide being engaged with the ribbon;

applying a resilient bias to the ribbon to apply a generally constant tension to the ribbon; and after a processing operation, rotating the supply roll using a motor in driving engagement with the supply roll.

11. The method of claim 10, wherein the resilient bias is applied to the movable ribbon guide in a direction to increase the length of the ribbon path.

12. The method of claim 10, further comprising determining the amount of ribbon remaining.

13. The method of claim 12, wherein determining the amount of ribbon remaining comprises determining the amount of ribbon remaining on the supply roll.

14. The method of claim 10, further comprising determining that the end of the ribbon on the supply roll has been reached.

15. A method of tracking usage of a consumable ribbon in identity document processing equipment having a document processing mechanism configured to process identity documents by performing processing operations on the identity documents that use the consumable ribbon, the method comprising:

providing a movable ribbon guide in a ribbon path between a supply roll supplying the ribbon and the document processing mechanism, the movable ribbon guide being engaged with the ribbon and which moves as the ribbon is used in the processing operation;

after a processing operation, determining the amount of ribbon remaining based at least in part on the extent of movement of the movable ribbon guide; and storing information on the amount of the ribbon remaining in a radio frequency identification tag disposed in the identity document processing equipment; and after a subsequent processing operation, determining a new amount of ribbon remaining based at least in part on the extent of movement of the movable ribbon guide, and storing information on the new amount of ribbon remaining in the radio frequency identification tag.

16. The method of claim 15, wherein storing information on the amount of ribbon remaining comprises determining the diameter of the ribbon supply roll, calculating the ribbon remaining and storing that information on the radio frequency identification tag.

17. The method of claim 15, wherein the radio frequency identification tag is fixed to the supply roll.

* * * * *